US010586673B2

(12) United States Patent
Heid

(10) Patent No.: US 10,586,673 B2
(45) Date of Patent: Mar. 10, 2020

(54) METAL JET X-RAY TUBE

(71) Applicant: SIEMENS AKTIENGESELLSCHAFT, München (DE)

(72) Inventor: Olivier Heid, Erlangen (DE)

(73) Assignee: Siemens Healthcare GmbH, Erlangen (DE)

( * ) Notice: Subject to any disclaimer, the term of this patent is extended or adjusted under 35 U.S.C. 154(b) by 283 days.

(21) Appl. No.: 15/538,431

(22) PCT Filed: Dec. 18, 2015

(86) PCT No.: PCT/EP2015/080504

§ 371 (c)(1),
(2) Date: Jun. 21, 2017

(87) PCT Pub. No.: WO2016/102370

PCT Pub. Date: Jun. 30, 2016

(65) Prior Publication Data

US 2017/0345611 A1 Nov. 30, 2017

(30) Foreign Application Priority Data

Dec. 22, 2014 (DE) ..... 10 2014 226 813

(51) Int. Cl.
*H01J 35/00* (2006.01)
*H01J 35/06* (2006.01)
(Continued)

(52) U.S. Cl.
CPC ..... *H01J 35/065* (2013.01); *H01J 35/02* (2013.01); *H01J 35/12* (2013.01);
(Continued)

(58) Field of Classification Search
CPC .... H01J 35/065; H01J 35/12; H01J 2235/062; H01J 2235/082; H01J 2235/086; H01J 35/02; H01J 2235/06
See application file for complete search history.

(56) References Cited

U.S. PATENT DOCUMENTS 4,953,191 A 8/1990 Smither et al.
5,052,034 A 9/1991 Schuster
(Continued)

FOREIGN PATENT DOCUMENTS

CN 102369587 A 3/2012
DE 2339225 A1 3/1974
(Continued)

OTHER PUBLICATIONS

Chinese Office Action for Chinese Application No. 2015800702083, dated Mar. 28, 2018.
(Continued)

*Primary Examiner* — Kiho Kim
(74) *Attorney, Agent, or Firm* — Lempia Summerfield Katz LLC

(57) ABSTRACT

The invention relates to a metal jet x-ray tube which is less affected by the problem of the power density at the point of impact of the electron beam on the anode component than conventional tubes. For this purpose the metal jet x-ray tube has a metal jet (6) as anode component (7), which metal jet is so thin that an electron beam (4) impinging on the metal jet (6) is only partially decelerated by the metal jet. Furthermore a blade cathode is provided as a cathode component (3), which blade cathode comprises a cathode blade (10) directed with a slight inclination downwards in the direction of the liquid metal jet (6) of the anode component (7).

6 Claims, 1 Drawing Sheet

(51) Int. Cl.
*H01J 35/02* (2006.01)
*H01J 35/12* (2006.01)

(52) U.S. Cl.
CPC ..... *H01J 2235/06* (2013.01); *H01J 2235/062* (2013.01); *H01J 2235/082* (2013.01); *H01J 2235/086* (2013.01)

(56) References Cited

U.S. PATENT DOCUMENTS

| | | | | |
|---|---|---|---|---|
| 6,002,744 | A | 12/1999 | Hertz et al. | |
| 7,929,667 | B1 | 4/2011 | Zhuang et al. | |
| 8,565,381 | B2 | 10/2013 | Sukowski et al. | |
| 8,837,679 | B2 | 9/2014 | Hemberg et al. | |
| 8,908,833 | B2 * | 12/2014 | Nonoguchi et al. .... | H01J 35/06 378/125 |
| 2004/0156475 | A1 | 8/2004 | Hatanaka et al. | |
| 2007/0258563 | A1 | 11/2007 | Harding | |
| 2011/0080997 | A1 | 4/2011 | Sukowski et al. | |
| 2012/0057680 | A1 | 3/2012 | Hemberg et al. | |
| 2013/0301805 | A1 | 11/2013 | Hemberg et al. | |
| 2016/0120012 | A1 | 4/2016 | Heid | |

FOREIGN PATENT DOCUMENTS

| | | | |
|---|---|---|---|
| DE | 102013209447 | A1 | 11/2014 |
| EP | 1305984 | A1 | 5/2003 |
| WO | WO03013197 | A1 | 2/2003 |
| WO | WO2005096341 | A1 | 10/2005 |
| WO | WO2009146827 | A1 | 12/2009 |

OTHER PUBLICATIONS

German Search Report for related German Application No. 10 2014 226 813.3 dated Aug. 13, 2015 with English Translation.

PCT International Search Report and Written Opinion of the International Searching Authority dated Apr. 12, 2016 for corresponding PCT/EP2015/080504, with English Translation.

* cited by examiner

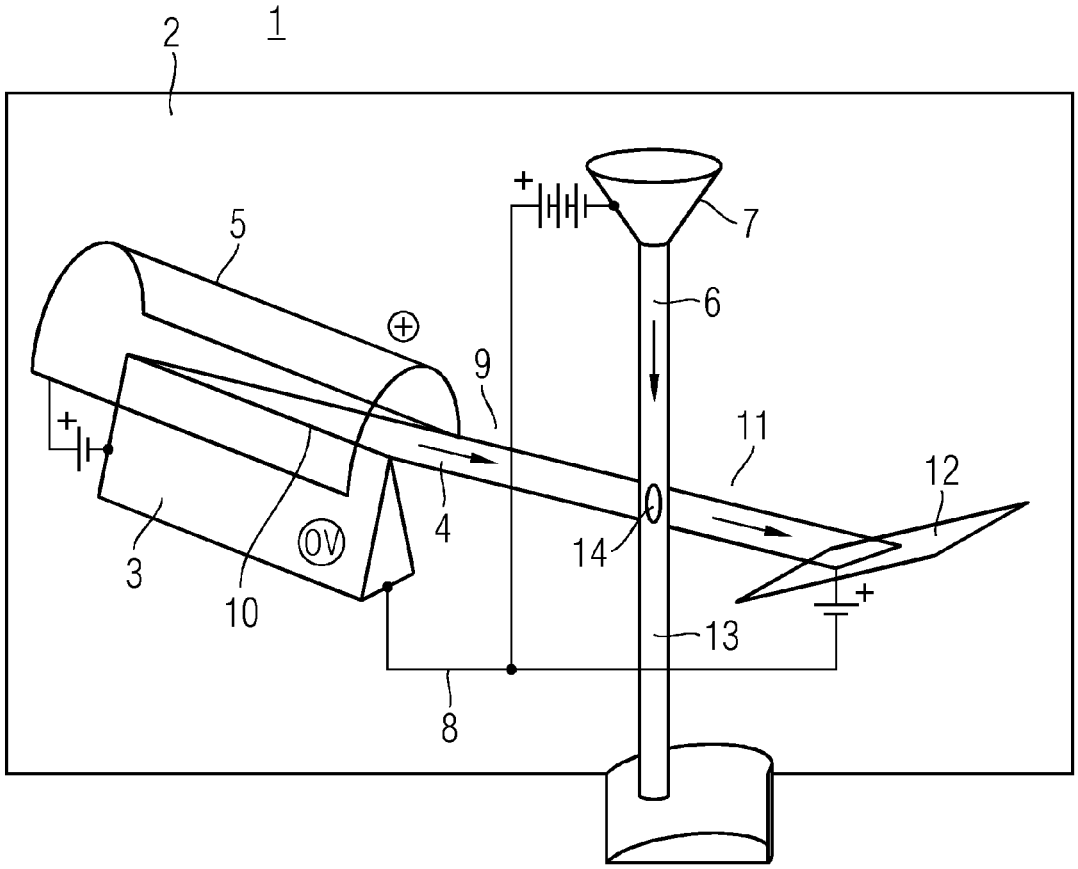
1
2
5
7
6
9
11
12
4
14
3
10
0V
13
8

METAL JET X-RAY TUBE

CROSS-REFERENCE TO RELATED APPLICATIONS

The present patent document is a § 371 nationalization of PCT Application Serial Number PCT/EP2015/080504, filed Dec. 18, 2015, designating the United States, which is hereby incorporated by reference. This patent document also claims the benefit of DE 102014226813.3, filed on Dec. 22, 2014, which is also hereby incorporated by reference.

TECHNICAL FIELD

Embodiments relate to a metal jet x-ray.

BACKGROUND

In stationary or rotary anode tubes, or metal jet x-ray tubes, there is the problem of a power density at a point of incidence of the electron beam on the anode component. High power losses are generated for given luminous intensities and focal spot luminances. Strong background magnetic fields, for example, caused in conjunction with magnetic resonance imaging scanners cause a problem. It is impossible to focus the electron beam using electrostatic in magnetic fields of such strength.

The problem of maintaining the solid or liquid aggregate state of the anode material in the focal point of the electron beam in rotation anode tubes and in metal jet x-ray tubes may be solved by virtue of the material of the rotary anode or of the metal jet being transported sufficiently quickly through the focal spot at the focal point of the electron beam. In the process, the electrons are decelerated to a standstill, even though only high-energy electrons cause the desired short-wave x-ray radiation. In view of the focal spot power deposition, and also in view of the efficiency, a drawback is the complete deceleration.

SUMMARY AND DESCRIPTION

The scope of the present invention is defined solely by the appended claims and is not affected to any degree by the statements within this summary. The present embodiments may obviate one or more of the drawbacks or limitations in the related art.

Embodiments provide a metal jet x-ray tube that is affected less than conventional stationary or rotary anode tubes, or previous metal jet x-ray tubes, by the problem of the power density at the point of incidence of the electron beam on the anode component.

In an embodiment, in a vacuum chamber, the metal jet x-ray tube includes a cathode component for extracting an electron beam and a provision for extracting the electron beam by the cathode component. The metal jet x-ray tube further includes an anode component formed by a liquid metal jet as a target for the emitted electron beam of the cathode component and a provision for accelerating the electron beam emitted by the cathode component within a vacuum path in the direction and with a target of the anode component. The metal jet x-ray tube includes a thin metal jet as an anode component, by which the electrons of the electron beam incident thereon are only partly decelerated. The metal jet x-ray tube includes a blade cathode as the cathode component. The blade cathode includes a cathode blade directed with a slight inclination downward in the direction of the liquid metal jet of the anode component.

A metal jet x-ray tube is provided with fast primary electrons that are accelerated along a first vacuum path in electrostatic or electrodynamic manner, and are only partly decelerated in a thin, relatively electron-transparent target medium.

However, the thin light-producing anode material may only absorb very little energy. At the end there is, at first, substantially the same power limit as in the case of a thick anode material. Physically very thin anode materials are required (e.g., with a thickness of 0.1 to 10 μm).

It may be very difficult to realize liquid metal jets in a form that differs from a round one. Hence, the focal spot diameter is likewise restricted to a very small size.

Further, the presence of a strong, homogeneous background magnetic field (e.g., in the case of use in a magnetic resonance imaging scanner) renders focusing the electrons by electrostatic impossible.

Therefore, in combination with the thin metal jet of the anode component, a blade cathode that produces a flat electron beam with a thickness that fits to the metal jet diameter such that a sufficiently large portion of the electrons emerging from the cathode are incident on the metal jet is provided.

In an embodiment, a further vacuum path is provided downstream of the anode component for the electrons of the electron beam that have not yet been completely decelerated. Within the further vacuum path, the electrons are decelerated at least virtually to standstill.

If this decelerating of the electrons is carried out together with an energy recuperation provision, the light production efficiency is increased.

An additional increase in the efficiency is provided by a metal jet of the anode component that is embedded in a second material or is dissolved in the second material. The second material passes electrons relatively well and is heat absorbing.

By way of example, the dissolution may be brought about in the form of an alloy or a mix. In contrast to previous metal jet x-ray tubes, an alloy or a mix facilitates physically relatively thick but electron-optically thin anodes with a large specific energy absorption capacity. Overall, the metal jet may have the cylindrical form with a diameter of the order of the electron beam diameter (e.g., 10 to 100 μm), while nevertheless having sufficient transmissivity from an electron-kinetic point of view. The mix or the alloy has a low melting point in order to facilitate the liquid jet formation. The improved energy absorption capacity of the anode material reduces the necessary anode beam speed and/or facilitates a higher power deposition and hence luminance of the focal spot.

BRIEF DESCRIPTION OF THE FIGURE

The FIGURE illustrates a metal jet x-ray tube according to an embodiment.

DETAILED DESCRIPTION

The FIGURE depicts a metal jet x-ray tube 1 including a vacuum chamber 2. A cathode component 3 is arranged in the vacuum chamber 2. The cathode component 3 serves to extract an electron beam 4. An extractor 5 for extracting the extraction of the electron beam 4 from the cathode component 3 is provided in the vacuum chamber 2. Also in the vacuum chamber 2 is an anode component 7 formed by a liquid metal jet 6. The liquid metal jet 6 is the target for the emitted electron beam 4 of the cathode component 3. An accelerator 8 is configured for accelerating the electron beam 4 emitted by the cathode component 3 in the direction and with the target of the anode component 7, at least within a vacuum path 9.

The metal jet 6 is configured as a thin metal jet. The electrons of the electron beam 4 are only partly decelerated by the metal jet 6. The cathode component 3 has a cathode blade 10 such that the cathode component 3 may also be referred to as a blade cathode. The cathode blade 10 is directed with a slight inclination downward in the direction of the liquid metal jet 6 of the anode component 7.

There is a further vacuum path 11 downstream of the anode component 7 for the electrons of the electron beam 4 that have not yet been decelerated completely. The vacuum path 11 serves to decelerate the only partly decelerated electrons downstream of the anode component 7 to a standstill. In an embodiment, the system also includes an energy recuperation provision 12.

While not depicted, the metal jet 6 of the anode component 7 is at least embedded or dissolved in a single second material 13 that passes electrons well and is heat absorbing.

In an embodiment, a blade cathode that is slightly inclined in relation to possibly present magnetic field lines is used. Additionally, in an embodiment according to FIG. 1, an alloy or a mixture made of at least two components as an x-ray beam producing anode material is used. Further, an energy recuperation provision 12 that captures the electron beam emerging from the metal jet 6 of the anode component 7 using an electrostatic collector is used. For example, as material 13 for the metal jet 6 of the anode component 7, a chemical element with an atomic number of 30 to 92 (e.g., barium, lanthanum, cerium, bismuth, tungsten etc.), and at least one heat-absorbing component that is relatively transparent to electrons and x-rays (e.g., a chemical element with an atomic number <20 such as lithium) are used.

The metal jet 6 is, for example, injected into the electron beam 4 by an injector such that bremsstrahlung and characteristic radiation are produced in the interaction zone 14. The transmitted and scattered electrons are decelerated in an electrostatic collector by way of a counteracting E-field with recuperation of energy and caught at a low velocity.

Easily melting metal alloys tend to have a high vapor pressure in the case of elevated temperatures, which promotes the deposition of conductive surface layers (e.g., on insulators). The metal jet 6 is guided through the discharge chamber for only a minimum length required for the interaction with the electron beam 4 and thereafter let to enter a wall-cooled condensation and collection container.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

While the present invention has been described above by reference to various embodiments, it may be understood that many changes and modifications may be made to the described embodiments. It is therefore intended that the foregoing description be regarded as illustrative rather than limiting, and that it be understood that all equivalents and/or combinations of embodiments are intended to be included in this description.

The invention claimed is:

1. A metal jet x-ray tube comprising:

a vacuum chamber;

a cathode component in the vacuum chamber for extracting an electron beam, wherein the cathode component comprises a blade cathode, the blade cathode comprising a cathode blade directed with an inclination downward in a direction of a liquid metal jet;

an extractor configured for extraction of the electron beam by the cathode component;

an anode component formed by the liquid metal jet as a target for the electron beam of the cathode component, wherein electrons of the electron beam incident on the liquid metal jet are only partly decelerated; and an accelerator configured to accelerate the electron beam extracted by the cathode component within a vacuum path in a direction targeting.

2. The metal jet x-ray tube of claim 1, wherein a further vacuum path is provided downstream of the anode component for the electrons of the electron beam that have not yet been completely decelerated, wherein in the further vacuum path, the electrons are decelerated to a standstill.

3. The metal jet x-ray tube of claim 2, wherein the deceleration of the electrons to the standstill is linked to an energy recuperation provision.

4. The metal jet x-ray tube of claim 2, wherein the metal jet of the anode component is embedded, dissolved, or embedded and dissolved in a single second material that passes electrons and is heat absorbing.

5. The metal jet x-ray tube of claim 3, wherein the metal jet of the anode component is embedded, dissolved, or embedded and dissolved in a single second material that passes electrons and is heat absorbing.

6. The metal jet x-ray tube of claim 1, wherein the metal jet of the anode component is embedded, dissolved, or embedded and dissolved in a single second material that passes electrons and is heat absorbing.

* * * * *